United States Patent [19]

Nicholas et al.

[11] Patent Number: 4,938,269

[45] Date of Patent: Jul. 3, 1990

[54] PAPERMAKER'S FELT SEAM WITH DIFFERENT LOOPS

[75] Inventors: Dimitri P. Nicholas, Savannah, Ga.; Pieter S. Diehl, Pleasant Hill, Ohio

[73] Assignee: The Orr Felt Company, Piqua, Ohio

[21] Appl. No.: 305,347

[22] Filed: Feb. 1, 1989

[51] Int. Cl.[5] ..... D03D 3/04; D03D 15/00

[52] U.S. Cl. ..... 139/383 AA; 428/58; 24/33 C; 162/DIG. 1

[58] Field of Search ..... 33/1 B; 428/57, 58, 428/280; 24/576, 583, 31 R, 31 H, 31 B, 33 P, 33 C; 139/383 AA, 383 A, 425 A; 162/DIG. 1; 245/10

[56] References Cited

U.S. PATENT DOCUMENTS

| | | | |
|---|---|---|---|
| 2,883,734 | 4/1959 | Draper, Jr. . | |
| 2,893,007 | 7/1959 | Windt . | |
| 2,907,093 | 10/1959 | Draper, Jr. . | |
| 3,283,388 | 11/1966 | Kelleher et al. . | |
| 3,622,415 | 11/1971 | Kunsman | 245/10 X |
| 3,815,645 | 6/1974 | Codorninu . | |
| 4,095,622 | 6/1978 | MacBean . | |
| 4,123,022 | 10/1978 | Dutt et al. . | |
| 4,285,105 | 8/1981 | Kirpatrick | 24/587 X |
| 4,401,137 | 8/1983 | Cannon . | |
| 4,435,457 | 3/1984 | Servo et al. . | |
| 4,539,730 | 9/1985 | Romanski . | |
| 4,574,435 | 3/1986 | Luciano et al. . | |
| 4,601,785 | 7/1986 | Lilja et al. . | |
| 4,698,250 | 10/1987 | Talonen et al. . | |
| 4,737,241 | 4/1988 | Gulya . | |
| 4,743,482 | 5/1988 | Johansson et al. . | |
| 4,755,260 | 7/1988 | Sakuma . | |
| 4,764,417 | 8/1988 | Gulya . | |
| 4,775,446 | 10/1988 | Eschmann . | |
| 4,779,346 | 10/1988 | Schafer | 33/1 B |

FOREIGN PATENT DOCUMENTS

| | | | |
|---|---|---|---|
| 630975 | 11/1961 | Canada | 139/425 A |
| 2004084 | 8/1971 | Fed. Rep. of Germany | 24/33 C |
| 57-55358 | 2/1982 | Japan . | |

*Primary Examiner*—Andrew M. Falik

*Attorney, Agent, or Firm*—Biebel, French & Nauman

[57] ABSTRACT

A pin-seam type of wet papermaker's felt of the kind in which the seam includes a series of interfitted and transversely aligned pin-receiving loops, and in which alternate loops are associated with either one or the other of the felt ends. At least one of the series of loops is provided with a surface impression in the form of a distinctive color, which color is distinguished or different from the color of the loops associated with the other end of the felt so that when the loops are properly aligned, an alternating visual pattern is presented to indicate such proper alignment and to facilitate the threading of the pin therethrough.

3 Claims, 3 Drawing Sheets

PAPERMAKER'S FELT SEAM WITH DIFFERENT LOOPS

BACKGROUND OF THE INVENTION

This invention relates to papermaker's wet press felts and more particularly to such a felt in which the opposite ends are joined by a pin seam.

The prior patent art contains numerous examples on pin-seam type felts for paper making machines, along with discussions of the advantages which can be gained by using pin-seamed felt over a more conventional endless felt. These prior patents include the following U.S. and foreign patent documents:

Draper, Jr., 2,883,734 of April 28, 1959,
Kelleher, et al., 3,283,388 of November 8, 1966,
Codorniu, 3,815,645 of June 11, 1974,
Cannon, 4,401,137 of August 30, 1983,
Lilja et al, 4,601,785 of July 22, 1986,
Talonen et al., 4,698,250 of October 6, 1987,
Johansson et al., 4,743,482 of May 10, 1988,
Sakuma, 4,755,260 of July 5, 1988,
Japanese patent No. 57-55358.

Typically, the pin seam felt today is formed with a woven base fabric and carries one or more layers of needled batting material on one or both of the face surfaces of the base fabric. An advantage of the pin seam on such a felt is that the felt can be made as stiff as desired, and still get it threaded onto the paper making machine. If the same felt were woven endless, it would be very heavy, stiff, and difficult to install on the machine.

Difficulties are encountered in two general areas. The one of these difficulties resides in the necessity of threading the pin through the cross-machine fabric loops on the opposed ends of the felt. The ends of the felt must be brought together on the machine, and a flexible leader wire is threaded through the internested loops, a short section or length at a time. Then it is used to pull the pin through while pullling the leader out of a gap between loops. This is repeated across the width of the machine, which may exceed 400 inches. The tedious process is often made all the more difficult because of cramped space and poor lighting.

A second difficulty resides in the necessity of cutting through the layer or layers of needled batting at the pin seam joint, since the joint was temporarily joined during felt manufacture and batt needling. Once the batting layer has been severed at the seam, it is very difficult to join it together again on the machine.

SUMMARY OF THE INVENTION

It is believed that one reason why it is so difficult to reconnect the pin seam resides in the difficulty of seeing the seam-forming loops. This is due in part to the fact that the loops are formed of a generally clear monofilament material. The effort required to internest the seam-forming loops may be greatly reduced by increasing the visibility of the loops. In this invention, at least one opposed set of the loops is provided with a distinctive visual surface impression, such as a contrasting color, that is, a color which stands out from that of the opposed set of loops.

Preferably, each of the opposed sets of loops to be interdigitated or internested is formed or provided with a distinctive color unique to its set, which color contrasts with that of the opposed set. When such loops are brought together, the visual impression is that of a distinctively different color pattern. Thus, one set of loops may, for example, be colored red, and the other blue, which combine to make an alternating red-blue pattern.

It is therefore an object of this invention to provide an improved pin-seam type of papermaker's felt in which the seam-forming loops are provided with a visually identifiable surface impression, such as a distinctive color to enhance the visibility of the loops.

A further object of the invention is the provision of a felt, as outlined above, in which each of the sets of opposed seam-forming loops in formed or provided with a distinctive visual color.

These and other objects and advantages of the invention will be apparent from the following description, the accompanying drawings, and the appended claims.

BRIEF DESCRIPTION OF ACCOMPANYING DRAWINGS

DESCRIPTION OF PREFERRED EMBODIMENT

Figure 1:
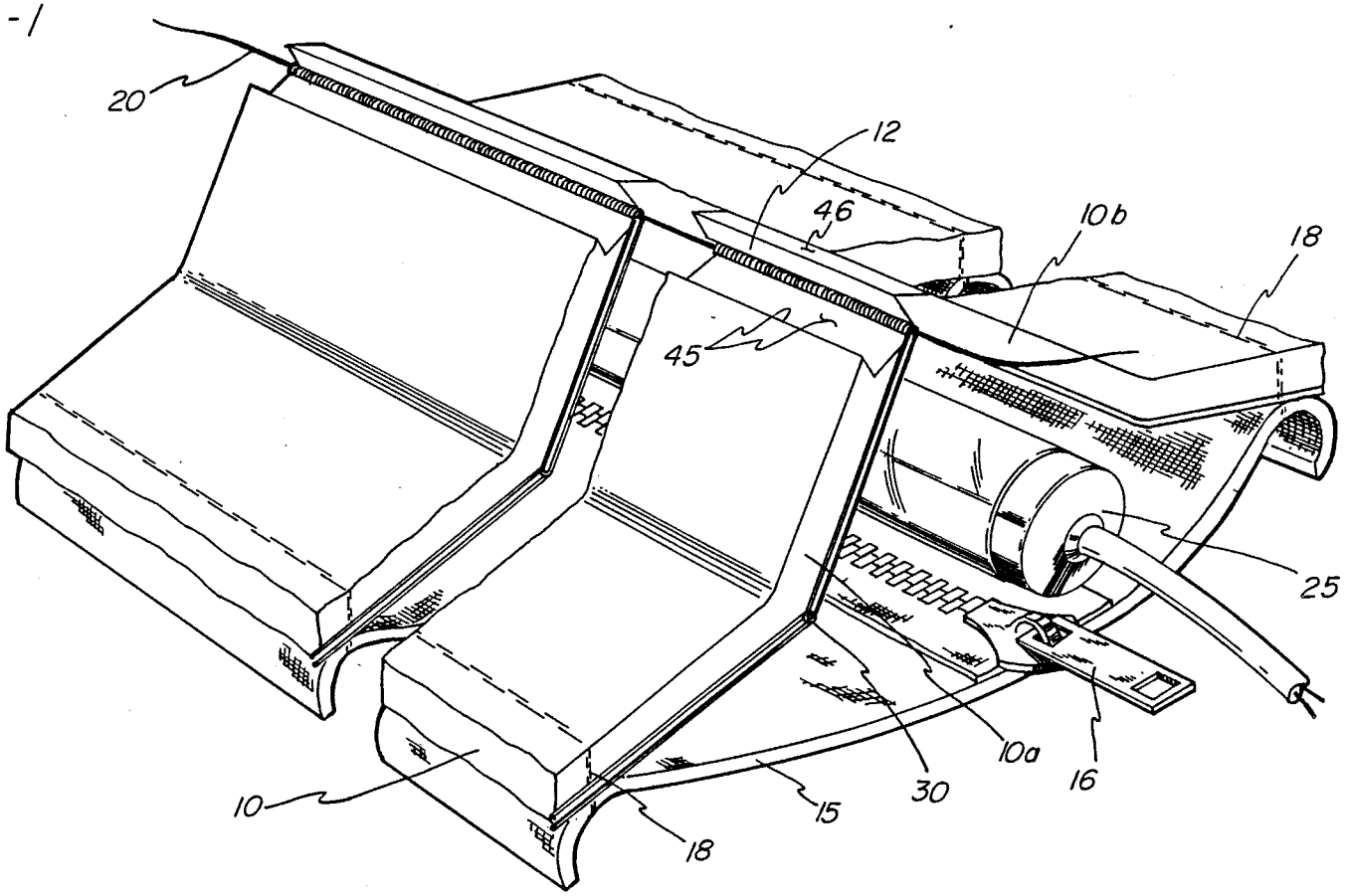
FIG. 1 is a perspective view, partially broken away, showing the assembly of the opposed ends of a pin seam formed in a needled felt of this invention.

Referring to FIG. 1, the improved papermaker's felt of the invention is shown at 10 as including a left-hand butt end **10*a* and a right-hand butt end 10*b*. The felt 10 is shown in FIG. 1 in the process of being joined at the pin seam 12 on a paper machine. The butt ends are brought and retained in juxtaposition by an arrangement known as a "tent". The "tent" is formed by a transversely positioned canvass support 15 formed in two parts which are joined by a slide fastener 16**.

Figure 3:
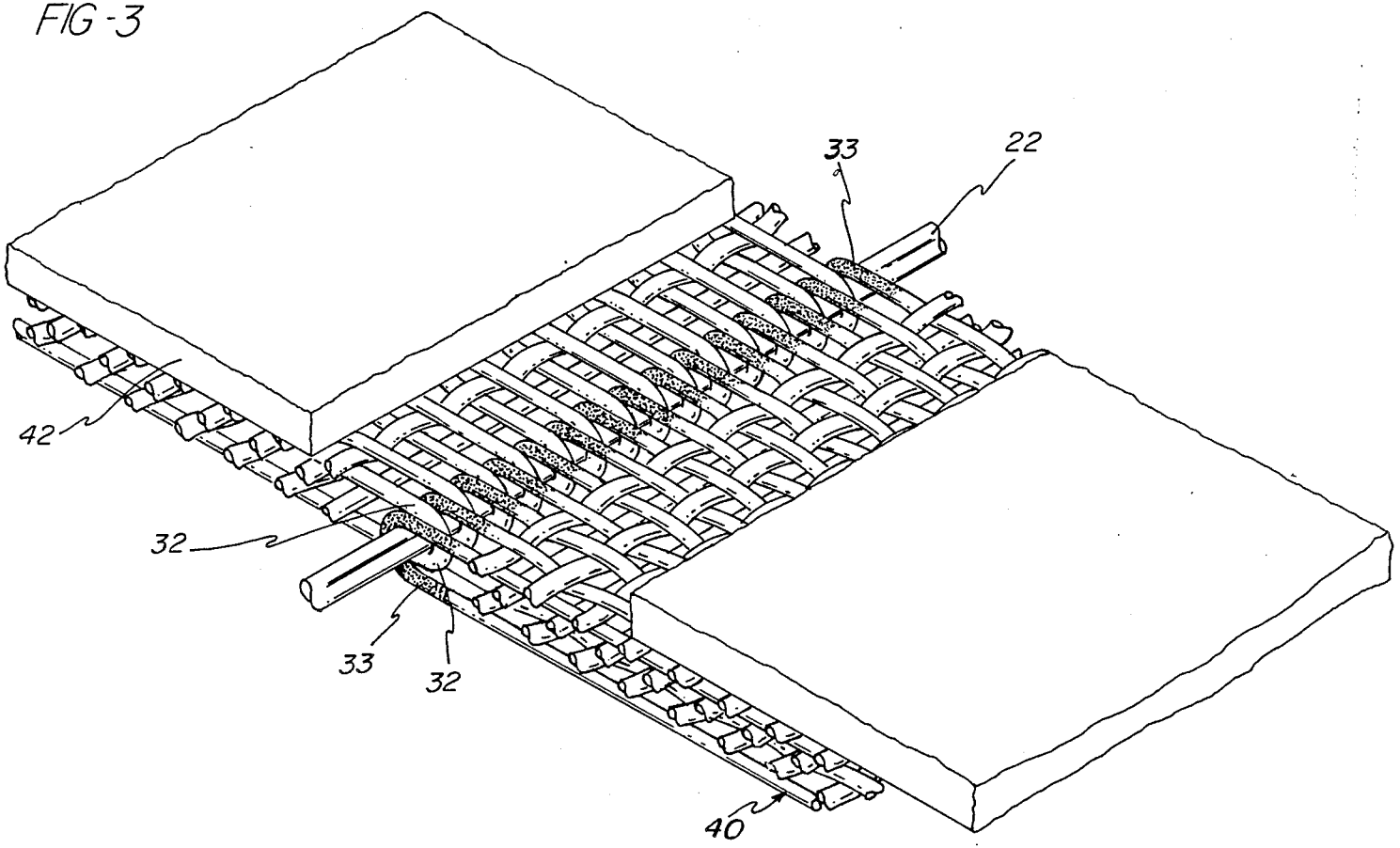
FIG. 3 is a prespective view showing the felt as joined along a pin seam, with the batting being broken away to expose the details of the pin seam.

The ends of the canvas support are temporarily joined to each of the butt ends **10*a*, 10*b* of the felt, such as by a chain stitch 18, and when the ends are brought together on the machine, they are held by the joining together each of the canvas sections by the slide fastener. The butt ends are then elevated above the canvas 15 in the form of a tent, so that the loops forming the pin seam 12 may be brought together in interfitted alignment to accept the leader wire 20, to pull through the pin 22 (FIG. 3). A fluorescent tube 25 may be inserted into the tent space above the canvas 15 and underneath the seam 12, to illuminate the seam and aid in seeing the loops and the leader wire 20**.

The handling of the butt ends and the interfitting of the seam-forming loops may be materially assisted by providing a transverse hinge or region 30 of enhanced flexibility in one or both of the felt ends as more fully described in application of Nicholas et al., Ser. No. 305,320 filed February 1, 1989 (Docket ORR 014 P2), filed concurrently herewith. The alignment of the seam loops may be materially enhanced by forming the respective end loops, 32, 33 (FIG. 2) of contrasting colors.

Figure 2:
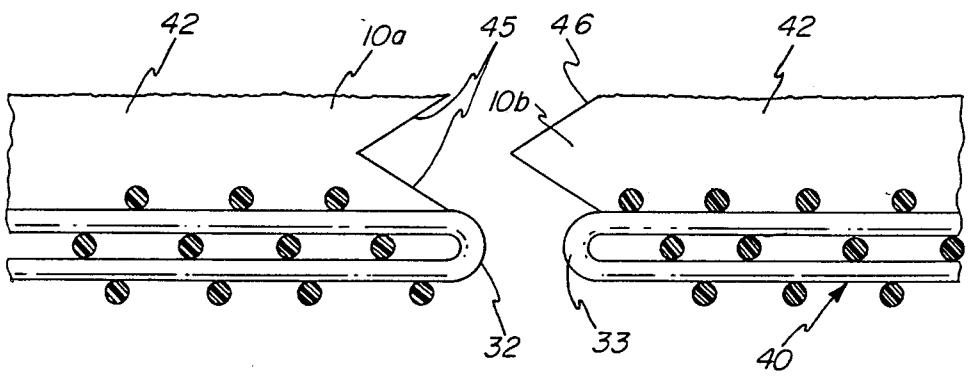
FIG. 2 is a diagrammatic side view of the opposed ends of the felt after the batting layer is cut and prior to assembly on the paper machine.

As shown in FIGS. 2 and 3, the felt 10 has a woven base fabric structure 40 and a batting layer 42 applied as by needling into the base fabric, as is well known in the art. The batting layer 42 is severed in the region of the seam 12 defined by the loops 32, 33 to form an interlocking means in the form of a transverse Vee groove 45 and a mating protruding Vee 46 in the opposed free end of the batting. The interlocking portions are formed when the batting layer 42 is cut to expose the pin seam, and when the previously connected ends are brought together again, the parts will perfectly mate.

With reference to FIG. 3, shaded seam-forming loops 33 are provided with a distinctive surface effect or impression in the form of color which contrasts with the color of the unshaded loops 32. This impression may be applied as a dye or more simply, by a felt tipped marker.

One or both of the opposed loop sets may be so marked with distinctive and contrasting colors, and as previously mentioned, these may be colors which compliment each other in the sense that when the sets are internested, as shown in FIG. 3, the effect is the appearance of a distinctively different visual pattern than seen when viewing either set separate. In this manner, the technician making the assembly or the joint can much more readily see when the loops are in proper position to receive the leader wire 20 and the pin 22. The time required to make the assembly should be greatly reduced by this means of increasing the visibility of the formed seam.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a papermaker's felt having opposed ends in which ends are connected by a pin seam, and in which said seam includes a series of interfitted transversely aligned pin-receiving loops, in which successive alternate said loops are associated with one or the other of said opposed ends, the improvement comprising:

all the said loops associated with one of said ends having a first color which is distinctively different in appearance from a second color of all the said loops associated with the other said end of said felt to facilitate the internesting of said loops for the threading of the connecting pin therethrough by forming the appearance of alternating first and second colors when the loops are properly aligned.

2. In a papermaker's felt having opposed ends in which said ends are connected together at a pin seam, and in which said seam is formed by a transverse series of alternating interfitted and transversely aligned pin-receiving loops, and in which alternate said loops are associated with one or the other of said felt opposed ends, the improvement comprising:

at least all said loops associated with one of said ends being formed with a first surface configuration providing a distinctively different visual impression from a second surface configuration of all the interfitting loops associated with the other of said ends, so that when said loops are interfitted so as to receive said pin, the seam provides a visual effect of alternating first and second surface impressions.

3. The felt of claim 2 in which said surface impressions each comprise a different distinctive color.

* * * * *